United States Patent [19]

Harmon

[11] Patent Number: 4,870,387

[45] Date of Patent: Sep. 26, 1989

[54] BEAM STRENGTHENED CUTOUT INSULATOR

[75] Inventor: Robert W. Harmon, Centralia, Mo.

[73] Assignee: A. B. Chance Company, Centralia, Mo.

[21] Appl. No.: 170,031

[22] Filed: Mar. 21, 1988

Related U.S. Application Data

[62] Division of Ser. No. 113,736, Oct. 28, 1987.

[51] Int. Cl.[4] ..... H01H 71/10; H01H 85/02; H01B 17/06

[52] U.S. Cl. ..... 337/168; 337/180; 337/202; 174/177; 174/212

[58] Field of Search ..... 337/167, 168, 169, 170, 337/171, 172, 173, 174, 175, 176, 177, 178, 179, 180, 181, 202, 222, 223, 224; 174/158 R, 165, 177, 212, 137 B

[56] References Cited

U.S. PATENT DOCUMENTS 2,961,518 11/1960 Hermann ..... 174/137 B
2,986,619 5/1961 McCloud ..... 337/223

FOREIGN PATENT DOCUMENTS 1378067 10/1964 France ..... 174/177

*Primary Examiner*—H. Broome
*Attorney, Agent, or Firm*—Hovey, Williams, Timmons & Collins

[57] ABSTRACT

An improved, integrally cast, synthetic resin insulator (22) especially adapted for use in an electrical cutout device (20) is provided which can be readily fabricated and gives greatly enhanced beam strength and arc track resistance characteristics. The preferred insulator (22) is cast using an epoxy resin such as bisphenol A filled with a relatively large quantity of glass beads and hydrated alumina. The filler fraction contributes to lowered viscosity, deaerability and improved settling properties while the resin is in an uncured state, and moreover enhances the arc track resistance and mechanical strength of the resin system after curing. The preferred insulator (22) is cast to present a longitudinal bow giving the insulator (22) an arcuate central axis. Further, the periphery of the insulator (22) is formed with a series of superposed, generally oval-shaped in cross-section, outwardly flaring skirts (30) interconnected by smooth transition regions (32) free of stress-inducing sharp corners. By virtue of the oval-shaped skirts (32), the insulator (22) has a greater effective width than thickness, thus maximizing the beam strength of the insulator (22).

9 Claims, 3 Drawing Sheets

20
22
24
26
28
30
32
34
36
38
40
42
44
46
48
50
52
54
56
58
60
62
64
66
68
70
72
74
76
78
80
82
84
86
88
90
92

BEAM STRENGTHENED CUTOUT INSULATOR

This is a division of application Ser. No. 07/113,736, filed on 10/28/87.

BACKGROUND OF THE INVENTION

1. Field of the Invention

The present invention is broadly concerned with an improved, filled synthetic resin insulator body especially adapted for use in the context of electrical cutout devices and being characterized by enhanced arc track resistance and beam strength and the ability to employ embedded mounting hardware in the insulator body. More particularly, it is concerned with such an improved insulator, and a complete cutout device, wherein the insulator is formed of a cured epoxy resin matrix filled with a quantity of glass beads. Proper selection of the size and quantity of glass beads gives a desirably low viscosity to the resin system in an uncured state, while increasing the requisite electrical and strength properties of the resin system upon curing. The insulator is also desirably formed with an oval-like cross section to present a greater effective width than thickness, and with a longitudinal bow to give an arcuate central axis; this construction not only increases the mechanical beam strength, but maximizes the flashover distance of a completed cutout device.

2. Description of the Prior Art

Conventional electrical cutouts used in transmission and distribution systems broadly include an elongated, skirted insulator typically formed of porcelain, with a pair of endmost, laterally projecting, line-connecting metallic terminals. An elongated fuse assembly is mounted between and electrically couples the respective terminals, and is adapted to sever under the influence of a fault current in order to interrupt the current.

While such cutouts have long been used, they present a number of problems, particularly insofar as the insulator thereof are concerned. In particular, most prior cutout insulators are formed of porcelain. As a consequence, these insulators are without known exception configured as surfaces of revolution, e.g., they are of circular cross section throughout. This stems from the fact that virtually insuperable difficulties are presented in the fabrication of porcelain insulators having shapes other than surfaces of revolution. This manufacturing constraint in turn means that prior porcelain insulators cannot be formed with the most advantageous shape from the standpoint of structural intergrity. That is to say, when a cutout device operates, there can be substantial, potentially destructive forces imposed on the insulator. In order to absorb these relatively high magnitude forces, an insulator must possess the requisite degree of beam strength. If, however, it is only possible to fabricate an insulator as a surface of revolution, such an insulator must have a relatively large diameter to possess the necessary beam strength. On the other hand, if it were possible to fabricate such an insulator as a beam-like shape having a greater width than thickness, then maximum beam strength could be obtained while using a minimum of material. Thus, porcelain insulators are of necessity inefficient from a structural/mechanical strength point of view, because of the inability to fabricate porcelain as an insulator having the most optimum shape.

In addition, because of the use of porcelain in cutout insulators, it has been necessary to attach the terminals and mounting hardware as structurally distinct items, as opposed to being embedded in the porcelain itself. Prior expedients used in this context have included attaching the metallic end terminals and central mounting hardware by means of bands secured to the insulator body, or through the use of conventional sulfur cements. These techniques are troublesome not only because of the extra manufacturing steps involved, but also by virtue of the fact that the electrical characteristics of the overall cutout may be compromised when using such externally mounted hardeware.

In view of the forgoing difficulties, it has been proposed in the past to make use of synthetic resin materials in the fabrication of cutout insulators. For example, polyester and expoxy systems filled with hydrated alumina have been proposed for the manufacture of such insulators, see U.S. Pats. Nos. 2,961,518, 4,206,066, 3,511,922 and 3,838,055. However, these prior synthetic resin insulators have typically suffered from manufacturing difficulties (e.g., the material in an uncured state is extraordinarily viscous, making it difficult to cast), low mechanical strength, or relatively low arc track resistance in use. Accordingly, synthetic resin insulators have achived only moderate commercial success, and porcelain insulators are still in widespread use notwithstanding their inherent problems.

SUMMARY OF THE INVENTION

This present invention overcomes the problems described above, and provides a greatly improved synthetic resin electrical insulator especially designed for use in the context of cutout devices. In one aspect of the invention, the insulator is in the form of an elongated body having at least the outer surface thereof formed of a cured synthetic resin insulative material, this material including an epoxy resin matrix filled with quantity of glass beads. In another aspect of the invention, the insulator is longitudinally bowed to present an arcuate central axis so as to maximize the flashover distance between the fuse section of a completed cutout and the central mounting hardware for the insulator. Finally, in preferred forms, the insulator body is configured to present a plurality of superposed, outwardly flared skirts along the outer periphery thereof, with each of the skirts being generally oval-shaped in cross-section, and with the transition zones between adjacent skirts being free of stress-inducing sharp corners. Fabrication of such an oval-shaped insulator body gives the most desirable beam strength characteristics to the insulator body, as compared with circular in cross-section porcelain insulators.

In more detail, the insulators of the invention are advantageously formed entirely of a glass bead-filled epoxy resin material, wherein the glass beads are present at a level of at least about 40% by weight in the resin material, and most preferably from about 50% to 80% by weight. Moreover, it has been found that the most advantageous results can be obtained by using different sizes of glass beads in the fill, namely a quantity of relatively small diameter beads and a greater quantity of relatively large diameter beads. For example, it has been found preferable to use a glass bead fraction in the resin material comprising from about 15% to 30% by weight of the relatively small beads, and correspondingly from about 70% to 85% weight of the relatively large diameter beads. In terms of sizes, the small beads should have an average diameter of from about $6\times10^{-5}$ to $10\times10^{31}$ 5 inches, while the larger beads should have an average diameter of from about 0.01 to 0.03 inches. Spheriglass®, solid glass beads obtained from Potters Industries, Inc. of Hasbrouck Heights, New Jersey have been used in the resin formulations, namely those designated as size 3000 (small diameter beads) and size B (large diameter beads). Such beads are described in technical literature distributed by that company entitled "'E' Glass Comparative Properties", Particle Comparison Chart", and "Spheriglass TM Solid Glass Spheres For Use In Plastics", and all of these publications are incorporated by reference herein.

In addition to the use of glass beads, it has also been discovered that the insulator bodies can be improved by provision of a quantity of hydrated alumina filler. Such hydrated alumina is normally present at a level from about 15% to 30% by weight in the overall resin system. Alumina trihydrate sold by Solem Industries, Inc. of Norcross, Georgia has been used in the present formulations.

The preferred epoxy system may be formulated using one or more epoxy resins, the most common of which are the bisphenol A or cycloaliphatic resins. In practice, bisphenol A resin sold by Shell Chemical Company under the designation Epon 828 has been used to good effect in the invention. Moreover, other conventional additives such as standard curing agents (e.g., liquid anhydrides) and accelerators can be used as desired in the epoxy formulations.

It has been found that use of a glass bead fraction as part or all of a filler in the resin systems of the invention has an advantageous effect on the viscosity, de-airability, and settling tendency of the resins in an uncured state (preferred resin systems exhibit a viscosity at 140 ° F. of less than 100,000 cps, and more preferably less than 50,000 cps). This in turn greatly facilitates casting procedures using the resins hereof. Glass beads are also less abrasive to production equipment than other types of silica sands. Further, the resin systems in a cured state exhibit enhanced arc track resistance and mechanical strength.

By virtue of the fabrication characteristics of the epoxy resin systems of the invention, it is a very easy matter to produce insulators having the most desirable shapes and cross-sectional configurations, to thus achieve the highest degree of structural integrity and beam strength with a minimum of material. As noted above, the preferred insulators of the invention are longitudinally bowed to present an arcuate central axis, and moreover have an essentially oval-shaped or somewhat rectangular cross-sectional configuration. These shapes give the most desirable insulator from the standpoint of mechanical and electrical properties.

DESCRIPTION OF THE PREFERRED EMBODIMENTS

Figures 1, 2, 4, 5:
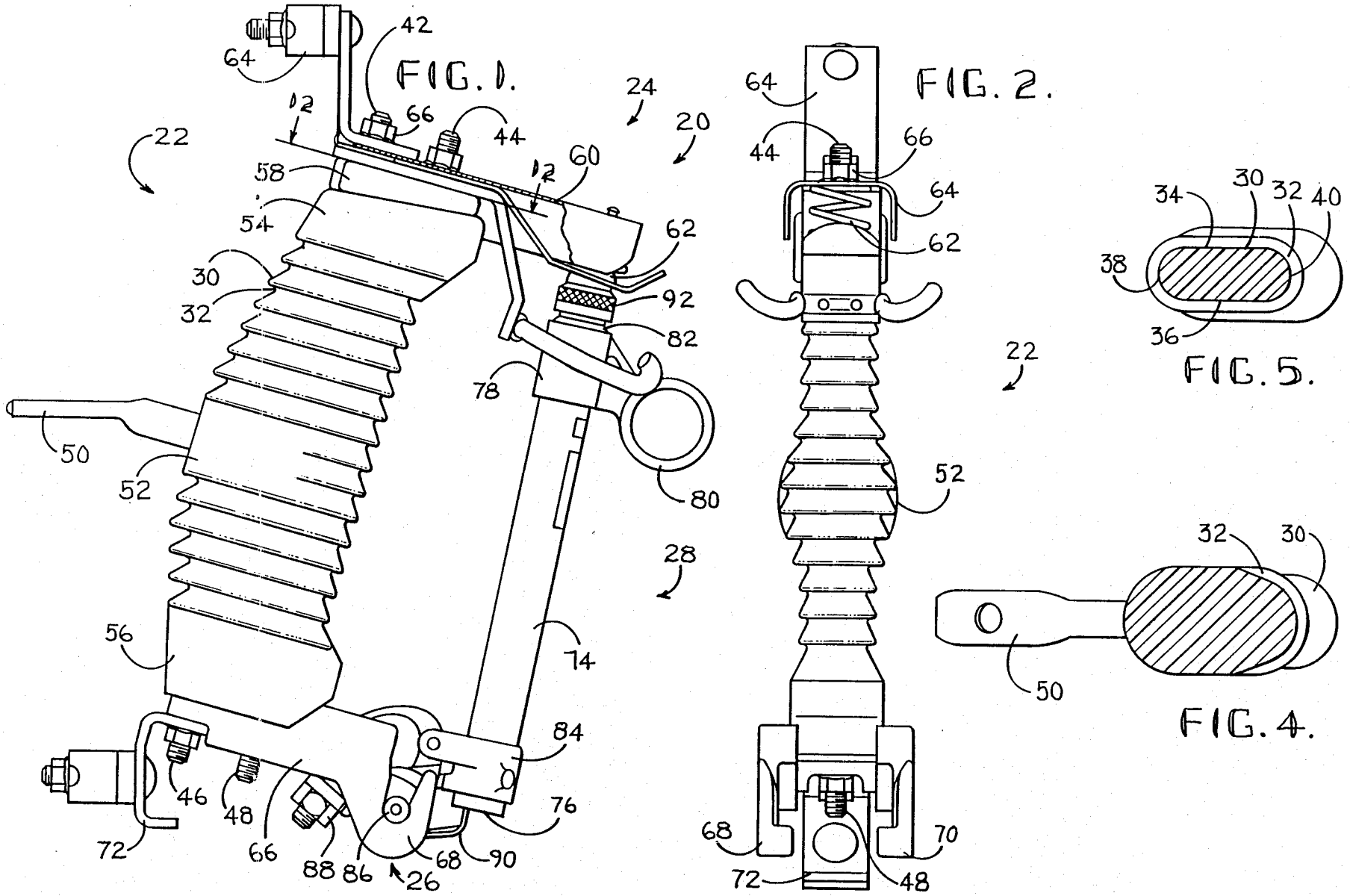
FIG. 1 is a side elevational view of an electrical cutout device in accordance with the invention, illustrating a longitudinally bowed, skirted synthetic resin insulator.
FIG. 2 is a front elevational view of the cutout illustrated in FIG. 1, shown with the fuse tube assembly removed to reveal the details of the insulator body.
FIG. 4 is a sectional view taken along line 4—4 of FIG. 3.
FIG. 5 is a sectional view taken along line 5—5 of FIG. 3.

Turning now to the drawings, a complete cutout device 20 is illustrated in FIG. 1. Device 20 broadly includes an elongated insulator body 22 equipped with a pair of endmost upper and lower electrical terminals 24, 26. An elongated fuse assembly 28 is situated in spanning relationship to the terminals 24, 26 in order to normally complete an electrical circuit therebetween. As those skilled in the art will readily appreciate, the device 20 is adapted to interposed in an electrical circuit, with the fuse assembly 28 being designed to sever upon experiencing a fault current, to thus clear the fault and interrupt current flow.

In more detail, it will be observed that the insulator 22 is in the form of an elongated, integrally cast, unitary body which is formed entirely from glass bead and dehydrated alumina-filled bisphenol A epoxy as described above. The body as cast is longitudinally bowed to present an arcuate central axis. Furthermore, the outer periphery of the insulator 20 presents a plurality of superposed, outwardly flaring skirts 30 with smooth, arcuate transition regions between adjacent skirts. Such regions totally eliminate stress-inducing sharp corners or the like. With particular reference to FIGS. 4 and 5, it will be seen that each of the skirts 30 is generally oval-shaped in cross-sectional configuration to present a pair of essentially rectilinear and parallel side surfaces 34, 36, joined by smoothly arcuate, substantially circular end will surfaces 38, 40.

Figure 3:
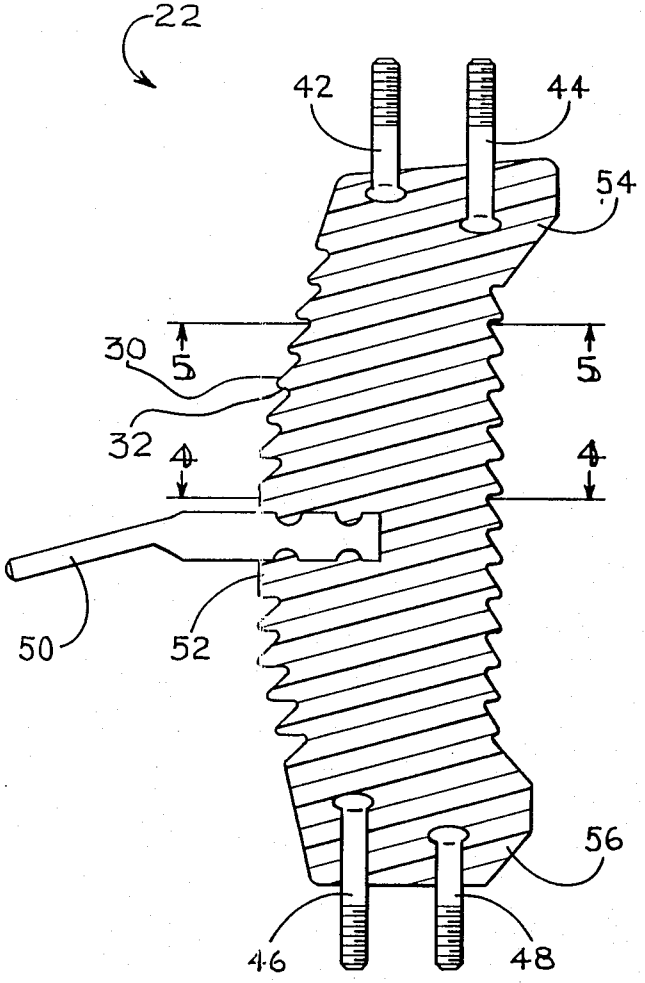
FIG. 3 is a vertical sectional view of the synthetic resin insulator forming a part of the cutout device depicted in FIGS. 1–2, showing the construction of the insulator and the embedded mounting hardware.
Figure 12:
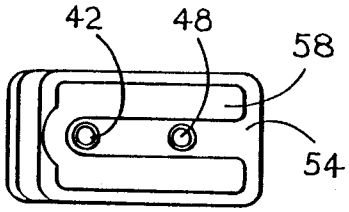
FIG. 12 is a view taken alone line 12—12 of FIG. 1 depicting the upper section of the insulator body with a wedge spacer affixed thereto.

As best shown in FIG. 3, the insulator 22 is provided with cast in place, embodiment mounting hardware in the form of upper terminal mounting bolts 42, 44, corresponding lower terminal mounting bolts 46, 48, and a central, rearwardly extending bracket 50. By virtue of the castable synthetic resin nature of insulator 22, it will be readily appreciated that such mounting hardware can be positioned within a two-part mold for the insulator during fabrication procedures.

The central region of the insulator body 22 adjacent bracket 50 is advantageously radially expanded as at 52 (see FIG. 2). Furthermore, the upper and lower ends of the insulator are each in the form of unskirted blocks 54, 56 presenting flat mounting surfaces for the adjacent terminals. In the case of upper block 54, it will be seen that a wedge-type bifurcated spacer 58 is interposed between the upper surface of the block and the underside of terminal 24. This spacer block may be used to achieve more precise clearances for the installation of fuse assembly 28.

The remaining components of cutout device 20 are essentially conventional. However, in order to insure completeness, it will be seen that upper terminal 24 includes a forwardly and downwardly extending U-shaped metallic body 60 carrying a spring-loaded upper fuse contact 62 and upwardly extending metallic line-connecting structure 64. The terminal body 60 and connection structure 64 are secured in place by means of nuts 66 secured to the upstanding embedded mounting bolts 42, 44.

Lower terminal 26 is likewise in the form of a forwardly extending metallic body 66, but has a pair of speed apart, slotted arms 68, 70. These arms cooperatively support the lower end of fuse tube assembly 28 as will be described. In addition, the body 66 carries a rearwardly and downwardly extending line connector 72.

The assembly 28 includes in elongated tube 74 lined with an arc-suppressing material such as bone fiber and presents a lowermost open end 76. The upper end of the tube 74 is provided with a ferrule 78 equipped with an operating ring 80 and an uppermost threaded section 82. The lower end of the tube 74 has a ferrule 84, the latter supporting a laterally extending gudgeon 86 adapted for reception within the slotted arms 68, 70 of terminal 26, as well as a fuse link connector 88.

A fusible element 90 is situated within tube 74 and extends from an uppermost threaded metallic cap 92 secured to section 82 downwardly through tube 74 and out open end 76 for securement to the connector 88. As those skilled in the art will readily appreciate, the link 90 is designed to sever upon experiencing a fault current with the result that the entire fuse tube assembly 28 will drop downwardly and outwardly away from upper contact 62. This gives a visual indication of current interruption, permitting ready replacement of the assembly 28 in the field. Furthermore, by virtue of the arc-suppressing lining provided in tube 74, any tendency to generate an arc upon link severence is rapidly suppressed, with ejection of arcing products downwardly and outwardly through open end 76 of the tube.

As indicated above, the upper and lower terminals 24, 26 and fuse assembly 28, are entirely conventional and well known to those skilled in the art. It will also be appreciated that an open link cutout arrangement could also be employed using an insulator in accordance with the invention, i.e., a cutout device which does not include an arc-suppressing fuse tube.

Figure 8:
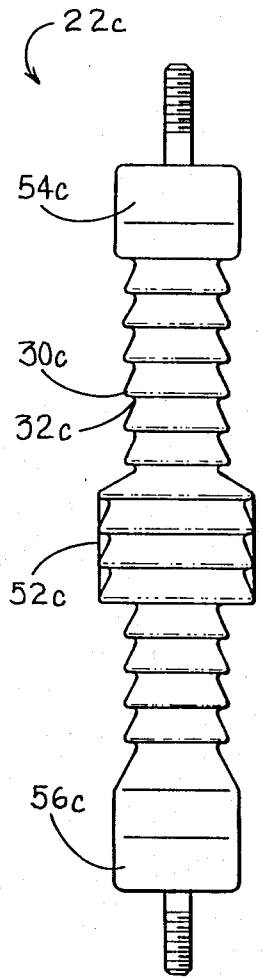
FIG. 8 is a front elevtional view similar to that of FIGS. 6 and 7 and showing a still further embodiment wherein the insulator has an expanded central section.
Figure 7:
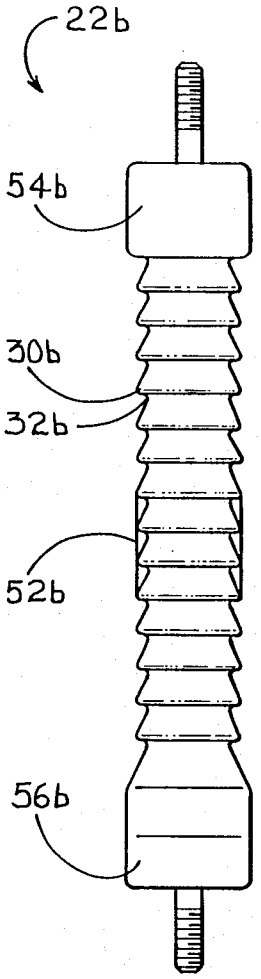
FIG. 7 is a front elevational view similar to that of FIG. 6 but showing another insulator embodiment.
Figure 6:
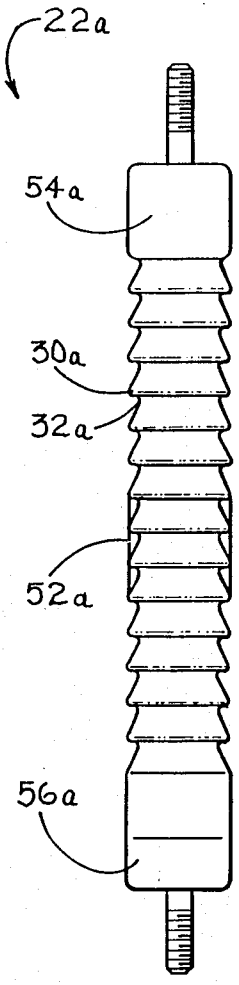
FIG. 6 is a front elevational view of another resin insulator in accordance with the invention and adapted for use in a cutout device.

FIGS. 6–8 illustrate three additional insulator **22*a*, 22*b* and 22*c* in accordance with the invention. Each of these insulators includes a plurality of superposed, outwardly flaring skirts 30*a*–30*c*, as well as corresponding, smoothly tapered transition regions 32*a*–32*c***. In addition, each includes embedded, upper and lower mounting bolts as illustrated. Finally, each of these insulators has a desirable beam configuration, i.e., with an effective width greater than the thickness thereof; and each is longitudinally bowed as in the case of the first-described embodiment.

Insulator **22*a* depicted in FIG. 6 is in most respects similar to insulator 22, but has a flattened central section 52*a*, as compared with the somewhat rounded corresponding section 52**.

Insulator **22*b* is in most respects indentical to the FIG. 6 embodiment, but in this case the upper and lower unskirted ends 54*b*, 56*b* are wider than the corresponding ends 54*a*, 56*a* illustrated in the embodiment of FIG. 6. The FIG. 8 embodiment, insulator 22*c*, includes the enlarged ends 54*c*, 56*c*, but further includes a central region 52*c* which has a plurality of radially enlarged skirts, as compared to the remaining skirts 30*c*** of the insulator.

Figure 11:
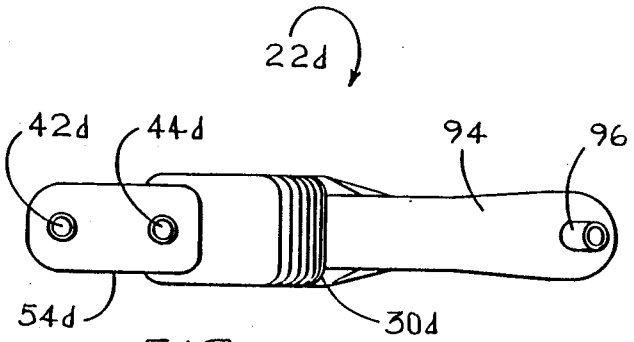
FIG. 11 is a plan view of the insulator illustrated in FIGS. 9 and 10.
Figure 10:
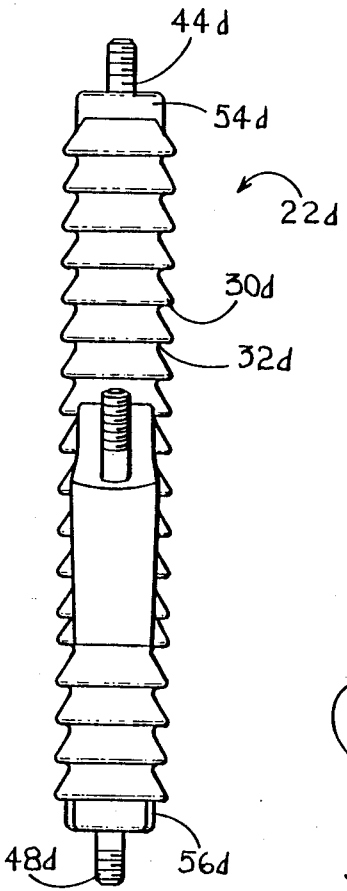
FIG. 10 is a rear elevational view of the insulator depicted in FIG. 9.
Figure 9:
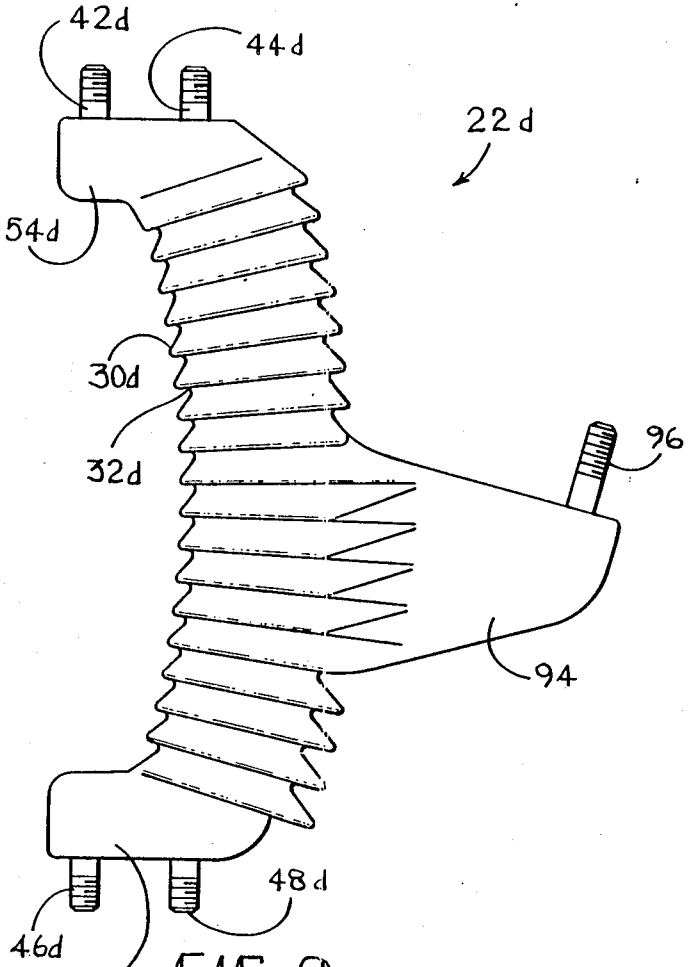
FIG. 9 is a side elevational view of a fourth embodiment of an insulator pursuant to the invention.

The final insulator embodiment is depicted in FIGS. 9–11 in the form of insulator **22*d*. This insulator is, as in the case of all of the preceding embodiments, an integrally cast, glass bead and hydrated alumina-filled epoxy body which has an arcuate central axis by virtue of the longitudinal bow thereof. In addition, the insulator 22*d* includes upper and ends 54*d*, 56*d*, end including corresponding outwardly projecting bolts 42*d*–48*d*. Then elongated, arcuate portion of the insulator 22*d* is further provided with a series of superposed, generally oval shaped in cross-section outwardly flaring skirts 30*d* with smooth transition regions 32*d* therebetween. The insulator 22*d* differs principally from the previous embodiment by provision of a rearwardly extending, somewhat triangular section 94 having an embedded, upstanding bolt 96 therein. The section 94** is useful in certain applications to facilitate mounting of a completed cutout device.

Although only the respective insulators themselves have been shown in the embodiments of FIGS. 6–11, it will be understood that each of these insulators is specifically adapted for use in assembly of a complete cutout device. This would involve merely attachment of the terminal hardware shown in the embodiment of FIGS. 1–2, together with an appropriate fuse assembly.

I claim:

1. An electrical cutout device comprising:

an elongated, integrally cast insulator body formed of synthetic resin material and having superposed, outwardly flared skirts about the periphery thereof over a substantial portion of the length of the body with a pair of generally opposed, endmost faces respectively defining the butt ends of the body, said insulator body being longitudinally bowed and presenting an arcuate central axis between said endmost faces;

respective elongated electrical terminals secured to said insulator body at end regions proximal to said endmost faces and including line-connecting structure for electrical connection of the device within an electrical circuit, each of said terminals extending laterally from a corresponding end region with the longitudinal axis thereof transverse to said central axis, each of said endmost faces lying in a plane which is generally parallel with the longitudinal axis of the corresponding adjacent terminal;

elongated fuse means adapted to sever upon experiencing a fault current; and means including an elongated fuse tube receiving said fuse means located in spanning relationship to said terminals for mounting said fuse means and electrically coupling the same with said terminals to complete an electrical circuit therebetween.

2. The cutout device of claim 1, at least certain of said skirts being generally oval-shaped in cross section.

3. The cutout device of claim 1, said insulator body presenting an effective width and an effective thickness, said width exceeding said thickness to increase the beam strength of the insulator body.

4. An electrical cutout device comprising:

an elongated insulator body presenting a pair of generally opposed, endmost faces defining the butt ends of the insulator body;

a pair of electrical terminals each including line-connecting structure for electrical connection of the device within an electrical circuit;

means operably coupling each of said terminals adjacent a corresponding butt end of said insulator body, including, for at least one of said terminals, shiftable, generally wedge-shaped spacer block means interposed between said one terminal and the adjacent endmost face of the insulator body, whereby the spacing between said terminals may be precisely established;

elongated fuse means adapted to sever upon experiencing a fault current; and means mounting said fuse means in spanning relationship to said terminals in order to normally complete an electrical circuit therebetween.

5. The cutout device of claim 4, said spacer means being interposed between the underside of the uppermost terminal and the upper endmost face of said insulator body.

6. An electrical cutout device comprising:

an elongated, integrally cast synthetic resin insulator body presenting a pair of opposed endmost faces defining the butt ends of the insulator body;

a pair of terminal mounting bolts embedded within each opposed end of said insulator body and extending outwardly through the corresponding endmost face, the embeded length of one of the bolts of each pair thereof being greater than the embedded length of the other bolt of the same pair;

a pair of electrical terminals each receiving a respective pair of said terminal mounting bolts for coupling of the terminals adjacent the opposed ends of said insulator body;

elongated fuse means adapted to sever upon experiencing a fault current; and means mounting said fuse means in spanning relationship to said terminals in order to normally complete an electrical circuit therebetween.

7. The cutout device of claim 6, the mounting bolts of each pair thereof being laterally spaced apart, said one bolt of each pair being directly opposed to the other bolt of the remaining pair.

8. The cutout device of claim 7, one of said terminals being an upper terminal with the remaining terminal being a lower terminal, said one bolt of the pair thereof mounting said upper terminal being closer to said fuse means, said one bolt of the pair thereof mounting said lower terminal being remote from said fuse means.

9. The cutout device of claim 6, each of said bolts including an enlarged head embedded within said insulator body.

* * * * *